US006170713B1

(12) United States Patent
Schultz

(10) Patent No.: US 6,170,713 B1
(45) Date of Patent: Jan. 9, 2001

(54) DOUBLE SPRING PRECOMPRESSION PUMP WITH PRIMING FEATURE

(75) Inventor: Robert Schultz, Old Greenwich, CT (US)

(73) Assignee: Emson, Inc., Stratford, CT (US)

( * ) Notice: Under 35 U.S.C. 154(b), the term of this patent shall be extended for 0 days.

(21) Appl. No.: 09/181,202

(22) Filed: Oct. 28, 1998

(51) Int. Cl.[7] ..... B65D 88/54
(52) U.S. Cl. ..... 222/321.2; 222/321.9
(58) Field of Search ..... 222/321.7, 321.9, 222/321.2, 341, 385

(56) References Cited

U.S. PATENT DOCUMENTS

| | | | | |
|---|---|---|---|---|
| 3,746,260 | | 7/1973 | Boris . | |
| 3,774,849 | | 11/1973 | Boris . | |
| 4,051,983 | | 10/1977 | Anderson . | |
| 4,144,897 | | 3/1979 | Kishi . | |
| 4,228,931 | * | 10/1980 | Ruscitti et al. | 222/321.9 |
| 4,694,976 | * | 9/1987 | Schuetz | 222/321.9 |
| 5,092,495 | * | 3/1992 | Andre | 222/321.2 X |
| 5,192,006 | | 3/1993 | Van Brocklin et al. . | |
| 5,638,996 | * | 6/1997 | Montaner et al. | 222/321.3 |
| 5,671,874 | * | 9/1997 | Behar et al. | 222/341 |

* cited by examiner

*Primary Examiner*—Kevin Shaver
*Assistant Examiner*—Thach H Bui
(74) *Attorney, Agent, or Firm*—Kenyon & Kenyon

(57) ABSTRACT

The invention relates to a precompression pump which includes a feature for opening the outlet valve at the bottom of the pump stroke, to thereby evacuate air and liquid from the pump chamber. The pump includes a gravity-biased inlet valve and a spring-biased outlet valve. Elevated pressure in the pump chamber causes the outlet valve to open against the bias of the outlet valve spring. At least one of the outlet valve or the inlet valve has an engagement end which engages the other valve at the bottom of the pump stroke, to thereby open the outlet valve against the bias of the outlet valve spring and exhaust air and liquid from the pump chamber to the spray nozzle. In this way, the pump chamber is evacuated so that liquid can be drawn into the pump chamber from the bottle or container. The present invention uses a simple design which is easy to mold, does not require close tolerancing, and which operates effectively without the need for difficult-to-mold friction fits.

49 Claims, 16 Drawing Sheets

DOUBLE SPRING PRECOMPRESSION PUMP WITH PRIMING FEATURE

BACKGROUND OF THE INVENTION

1. Field of the Invention

The present invention is directed to the field of precompression pumps. More particularly, the present invention is directed to a precompression pump used for dispensing, e.g., personal care products, from a container or bottle upon which the pump is mounted.

2. Description of the Related Art

Precompression pumps are known in the art. A precompression pump is a pump in which the outlet valve for the pump chamber opens in response to a predetermined pressure level within the pump chamber. Often, this is accomplished by providing an outlet valve having a surface upon which pressure in the pump chamber acts, and which is biased in a way that the outlet valve only opens when the pressure in the pump chamber is of a sufficiently high level. This type of pump is particularly useful for dispensing personal care products in a fine mist without dribbling.

A problem can arise in precompression pumps of the type described above during priming of the pump. When the pump chamber is in an unprimed condition—i.e., is filled with air instead of the liquid to be dispensed—it is necessary to evacuate air from the pump chamber in order to draw the liquid to be dispensed into the pump chamber. However, the air in the pump chamber can act as a compressible fluid. As a result, in certain precompression pump designs air in the pump chamber is compressed during the downstroke of the pump piston, and the pressure in the pump chamber does not achieve a sufficiently high level to open the outlet valve and release the air in the pump chamber through the pump nozzle. It is therefore difficult to evacuate the air from the pump chamber and to draw liquid into the pump chamber for dispensing. The result is that an undesirable number of "strokes to prime" may be necessary to operate the pump, if the air is not released from the pump chamber in some way other than through opening of the outlet valve.

Several patents describe mechanisms for assisting in the evacuation of air from a pump chamber to allow the pump to be primed. U.S. Pat. Nos. 3,746,260; 3,774,849; 4,051,983 and 4,144,987 show various mechanisms used to evacuate air from the pump chamber of a precompression pump. However, many of these mechanisms are unsatisfactory in that they can vary the volume of the dose, can cause wear or fatigue in the operating parts of the pump, or are difficult to mold. U.S. Pat. No. 5,192,006 shows a pump which includes a feature for evacuating air from the pump chamber. This pump, however, uses friction-operated inlet and outlet valves which can be disadvantageous for several reasons. First, in order for the friction-operated valves to operate properly, several parts must be closely toleranced to ensure proper frictional fits. In addition, the functional characteristics of the pump can vary depending on variations in the frictional fit between parts. Furthermore, any variations in tolerancing can result in frictional fits which can prevent the valves from opening and/or can cause the valves to remain open when they are intended to be closed. Finally, the design of the parts necessary to achieve the frictional fits involves detailed, and potentially expensive, molding equipment.

SUMMARY OF THE INVENTION

The present invention is advantageous in that it provides a precompression pump which is of a simple design, which ensures evacuation of air from the pump chamber to the spray nozzle, and which does not require close tolerancing and complicated molded parts to ensure proper and effective operation.

The present invention includes a pump housing defining a pump chamber in which a pump piston reciprocates. A pump spring biases the pump piston upwardly or axially outwardly. A gravity-biased inlet valve is located between the inlet or dip tube and the interior of the pump chamber. This inlet valve can be either a conventional ball-check valve or can be a gravity-biased stem valve. A spring-biased outlet valve is located between the interior of the pump chamber and the spray nozzle. This outlet valve opens in response to a specific internal pressure within the pump chamber. The outlet valve can be either a conventional ball-check valve, or a stem valve. The stem valve can have a conical sealing surface which cooperates with a conical sealing surface on the pump piston. In either case, the only contact between the outlet valve and the piston in which the outlet valve is housed is the fit caused by the outlet valve spring bias. At least one of either the inlet valve or the outlet valve has an engagement piece which interacts with the other valve of the pump at the bottom of the downstroke of the pump piston. This interaction opens the outlet valve, against the bias of the valve spring, thereby evacuating any air or liquid trapped in the pump chamber at the bottom of the downstroke of the pump. As a result, any compressed air in the pump chamber is mechanically evacuated from the pump chamber through the outlet valve, and the pump chamber is therefore capable of being filled with liquid from the container or bottle for subsequent spraying through the spray nozzle.

Several different variations on the design of the inlet and outlet valves are contemplated, and several variations are disclosed herein, although these variations do not limit the inventions which are contemplated within the scope of the invention.

DETAILED DESCRIPTION OF THE INVENTION

Figure 1:
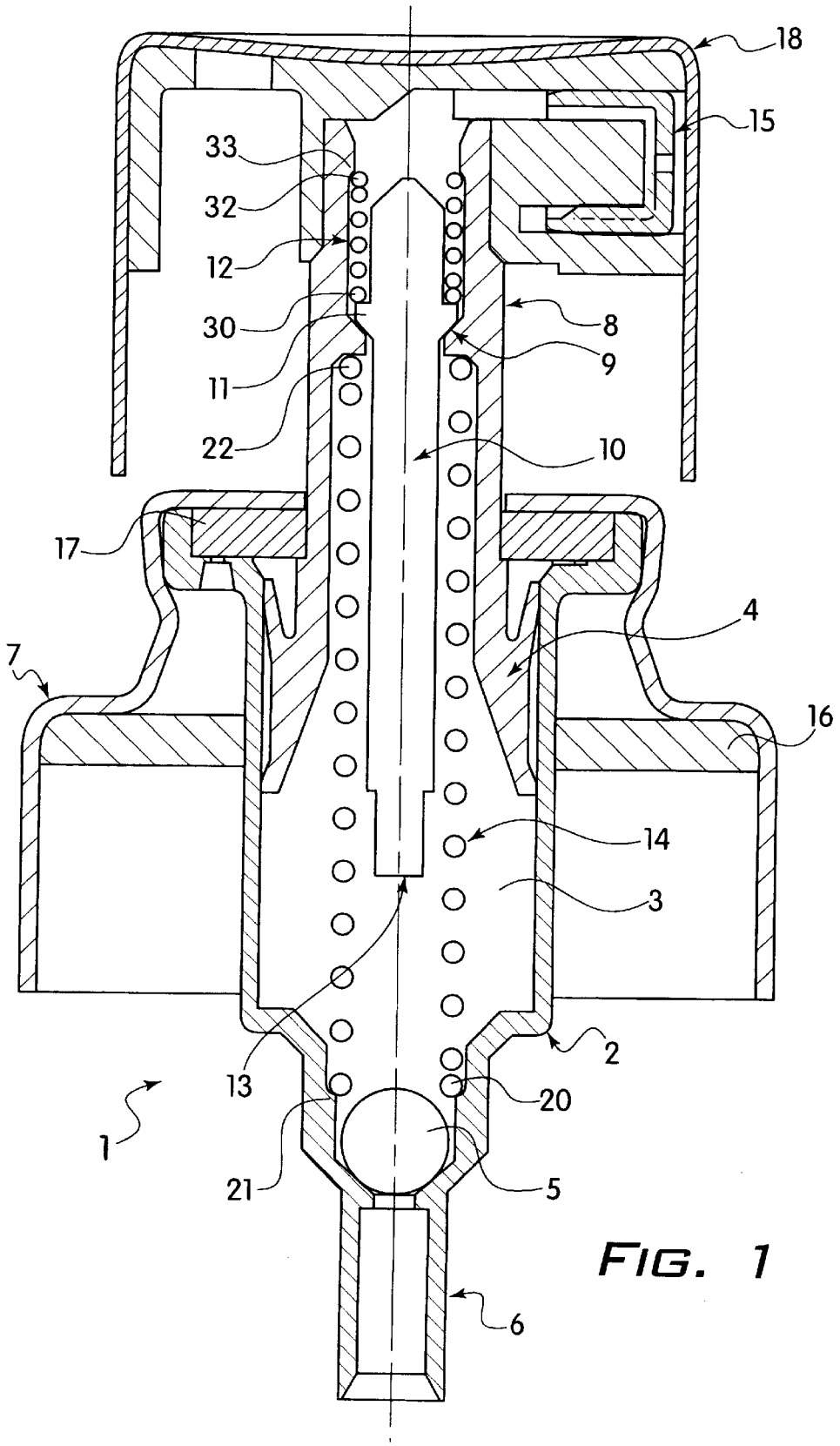
FIG. 1 is a cross-sectional view of a first embodiment of a pump dispenser of the present invention, in a non-depressed position.
Figure 2:
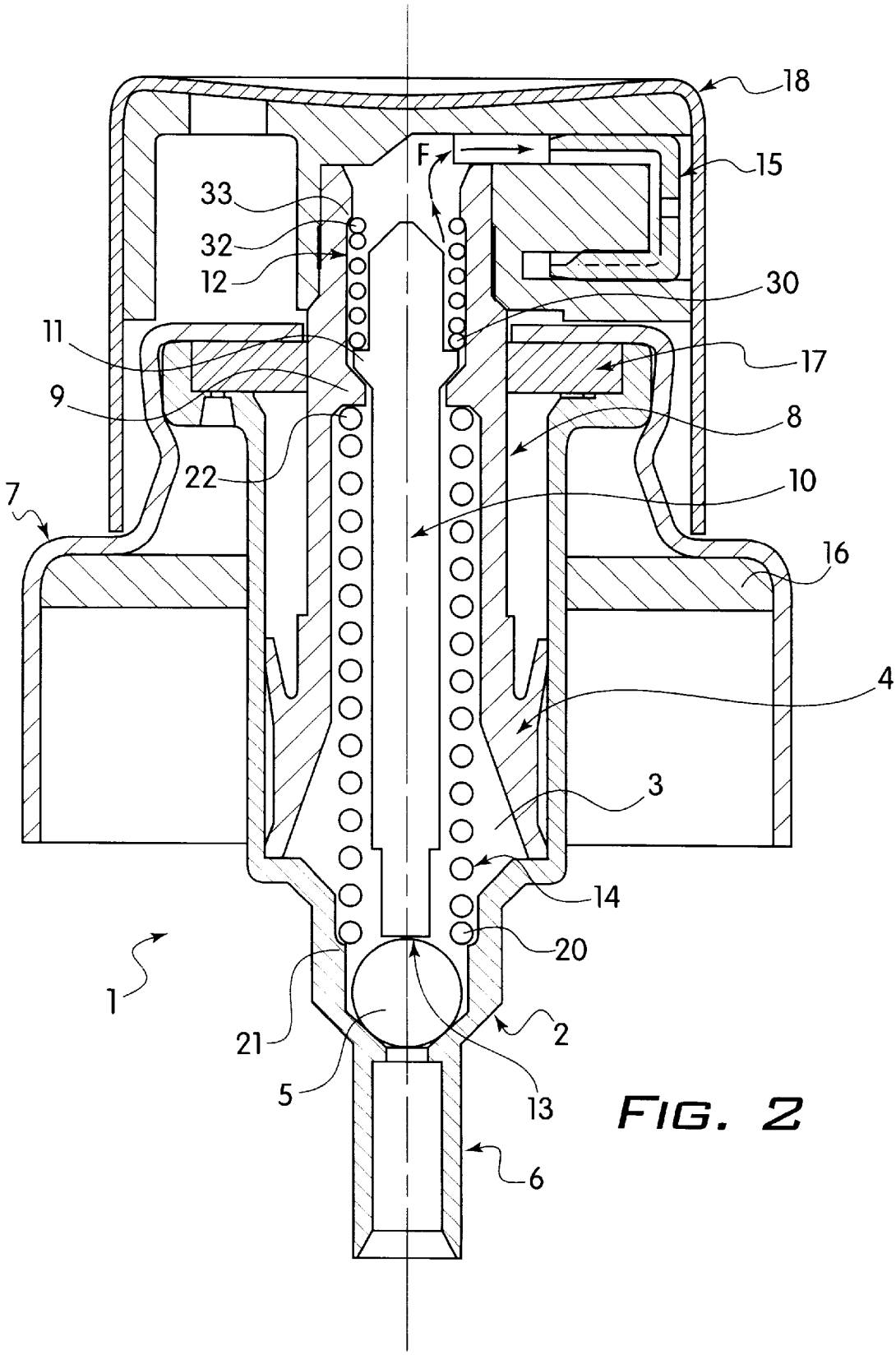
FIG. 2 is the embodiment of FIG. 2 in the depressed position at the bottom of the pump stroke.

FIGS. 1 and 2 show a first embodiment of the present invention. The pump 1 includes a pump housing 2 defining a pump chamber 3. Sliding within pump chamber 3 is a pump piston 4. At the lower end of pump chamber 3 is an inlet valve 5, which in the embodiment of FIGS. 1 and 2 is a gravity-biased ball-check valve. The inlet valve 5 controls the flow of liquid from the inlet tube 6 at the lower end of the pump housing 2, which inlet tube 6 is normally connected to a dip tube, as is conventional in the art. Inlet valve 5 is encircled completely within pump spring 14, and is thereby free to move without any interference with pump piston 4. The dip tube leads to the lower end of a bottle or container (not shown), upon which the pump 1 is mounted by a suitable mounting cup or cap 7. A pump spring 14 biases pump piston 4 in an upward or axially-outward direction. The pump spring 14 seats at its lower or axially-inward end 20 on a spring seat 21 in pump housing 3. Lower end 20 of pump spring 14 acts as a cage for inlet valve 5, restraining it from movement into pump chamber 3.

The piston stem 8 of pump piston 4 includes an inwardly-projecting piston sealing flange 9. Piston sealing flange 9, in the embodiment shown in FIGS. 1 and 2, can have a conical sealing surface. Piston sealing flange 9, on its lower or axially-inward side, acts as a seat for upper or axially-outward end 22 of pump spring 14. Mounted within piston stem 8 is an outlet valve 10. Outlet valve 10, in the embodiment of FIGS. 1 and 2, includes an outwardly-projecting valve sealing flange 11. Valve sealing flange 11, in the embodiment of FIGS. 1 and 2, has a conical sealing surface which is shaped to interact with and seal against the conical sealing surface on piston sealing flange 9. A valve spring 12 biases the outlet valve 10 so that valve sealing flange 10 seats against piston sealing flange 9. Valve spring 12 cooperates at one end 32 with the piston stem 8 at spring seat 33, and at the other end 30 cooperates with valve sealing flange 11, to thereby bias valve sealing flange 11 against piston sealing flange 9. Valve sealing flange 11 is structured so that its radially-outward edge is spaced from the radially-inward surface of pump piston 4. As a result, the only contact between outlet valve 10 and pump piston 4 is at the conical sealing surfaces under the bias of valve spring 12.

Outlet valve 10 includes an axially-inwardly projecting outlet valve engagement end 13. As shown in FIG. 2, outlet valve engagement end 13 is manufactured to be of sufficient distance from valve sealing flange 11 such that, at the bottom of the stroke of pump piston 4, the outlet valve engagement end 13 contacts inlet valve 5 so as to disengage sealing contact between valve sealing flange 11 and piston sealing flange 9, against the bias of valve spring 12. As will be described below, this disengagement of contact or unseating of outlet valve 10 allows trapped air or liquid in the pump chamber 3 to escape out the spray nozzle 15. The pump 1 can include conventional sealing gaskets 16, 17, spray head 18, and nozzle 15, as are well-known in the art.

In operation, finger pressure on spray head 18 is applied to the pump in the non-depressed condition shown in FIG. 1. Downward, or axially-inward, movement of spray head 18 causes pump piston 4 to compress the fluid within pump chamber 3. When sufficient pressure has built up within pump chamber 3 as a result of downward movement of pump piston 4, this pressure will act on the downwardly or axially-inwardly facing surfaces on outlet valve 10 to overcome the bias of valve spring 12, thereby unseating outlet valve 10 by disengaging the conical sealing surfaces on piston sealing flange 9 and valve sealing flange 11. The resulting gap between these surfaces (shown in FIG. 2) allows pressurized fluid to flow out of pump chamber 3, and thereafter out of spray nozzle 15. The outlet valve 10 will remain open throughout the downward, or axially-inward, movement of pump piston 4, as long as sufficient pressure in maintained within pump chamber 3 to overcome the biasing force of valve spring 12.

FIG. 2 shows the pump 1 of FIG. 1 at the bottom of the pump stroke. In this position, the outlet valve engagement end 13 of outlet valve 10 contacts the upper end of inlet valve 5. As inlet valve 5 is, in this position, seated against the bottom of pump housing 2, engagement of outlet valve engagement end 13 and inlet valve 5 causes piston sealing flange 9 and valve sealing flange 11 to disengage from one another, against the bias of valve spring 12, thereby allowing any trapped air or liquid within pump chamber 3 to flow out of pump chamber 3 and out spray nozzle 15. The flow of air or liquid out of pump chamber 3 is indicated by arrows F.

After the pump 1 is in the position shown in FIG. 2, finger pressure is released from spray head 18. Piston spring 14 biases pump piston 4 upwardly, increasing the volume of pump chamber 3 and thereby decreasing the pressure in pump chamber 3. As a result, outlet valve 10 closes, as the bias of valve spring 12 causes valve sealing flange 11 to seal against piston sealing flange 9. Inlet valve 5 opens, as the decreased pressure in pump chamber 3 unseats inlet valve 5 against the force of gravity, allowing liquid to be drawn into pump chamber 3 through inlet tube 6 and any attached dip tube (not shown). Pump chamber 3 fills, and pump piston 4 continues to move upwardly, until it reaches the position shown in FIG. 1.

Figure 3:
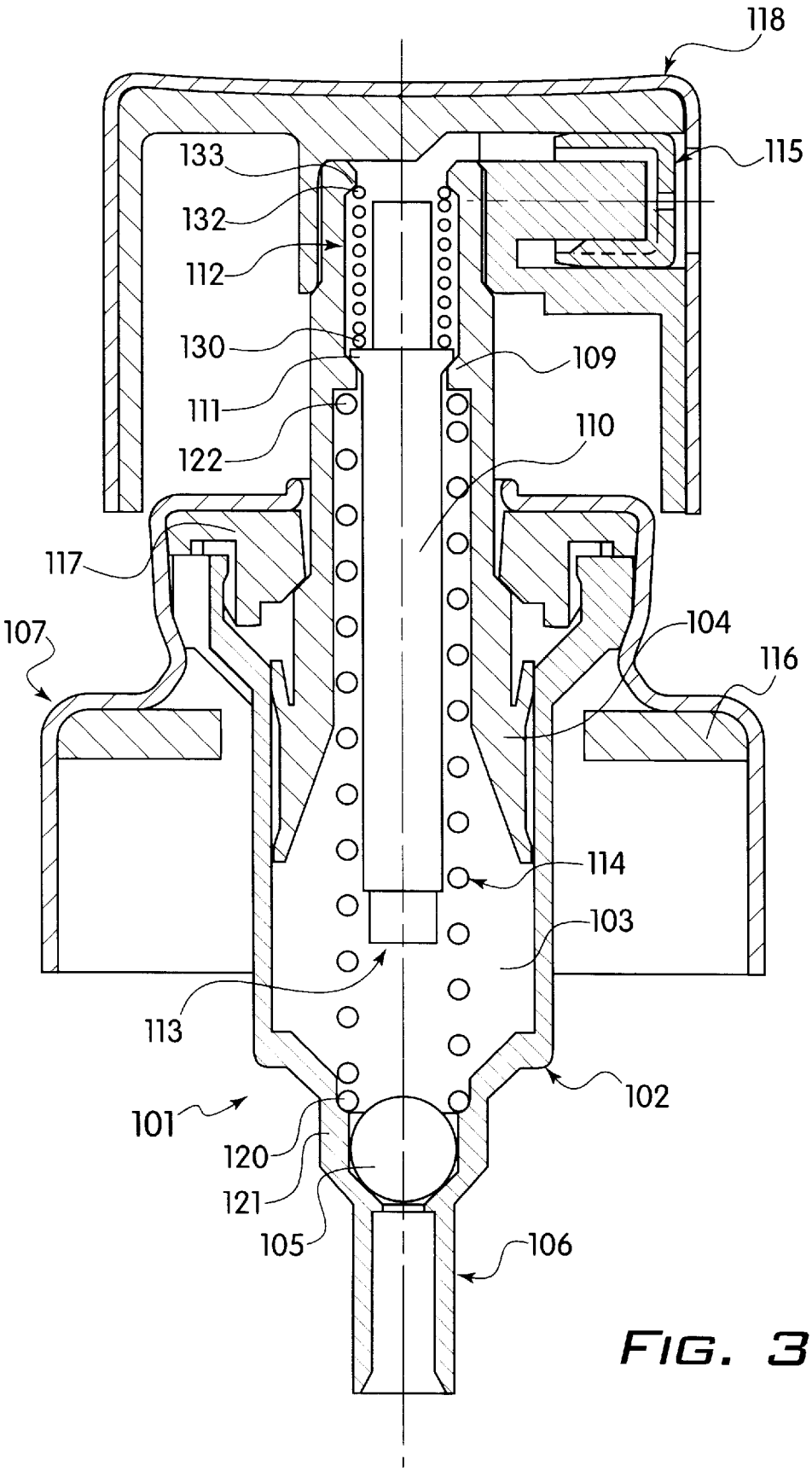
FIG. 3 is a cross-sectional view of a second embodiment of a pump dispenser of the present invention, in a non-depressed position.
Figure 4:
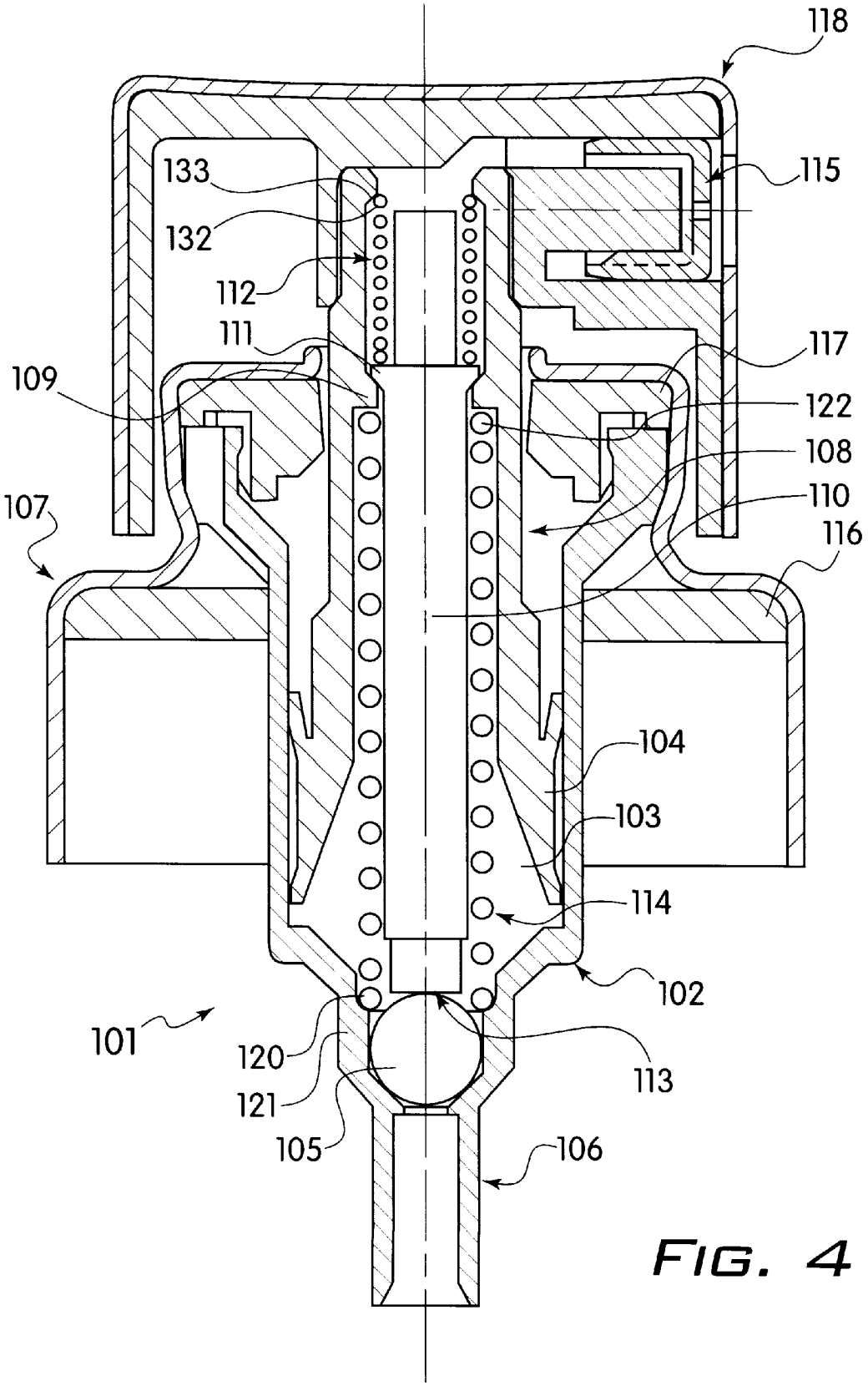
FIG. 4 is the embodiment of FIG. 3 in the depressed position at the bottom of the pump stroke.

FIGS. 3 and 4 show a second embodiment of the pump of the present invention. The design of the pump 101 of the embodiment of FIGS. 3 and 4 is very similar to that of the embodiment of FIGS. 1 and 2, except that the pump structure of the embodiment of FIGS. 3 and 4 is of a modular design (i.e., the pump components fit together to form a modular unit for insertion into mounting cup or cap 107), and the upper end of outlet valve 110 is slightly different in shape. In all other respects, however, the embodiment of FIGS. 1 and 2 and FIGS. 3 and 4 are identical in structure and operation. Similar elements in the embodiment of FIGS. 3 and 4 are designated with identical reference numerals to those used with the embodiment of FIGS. 1 and 2, except for the addition of the "100" prefix in the embodiment of FIGS. 3 and 4.

Figure 5:
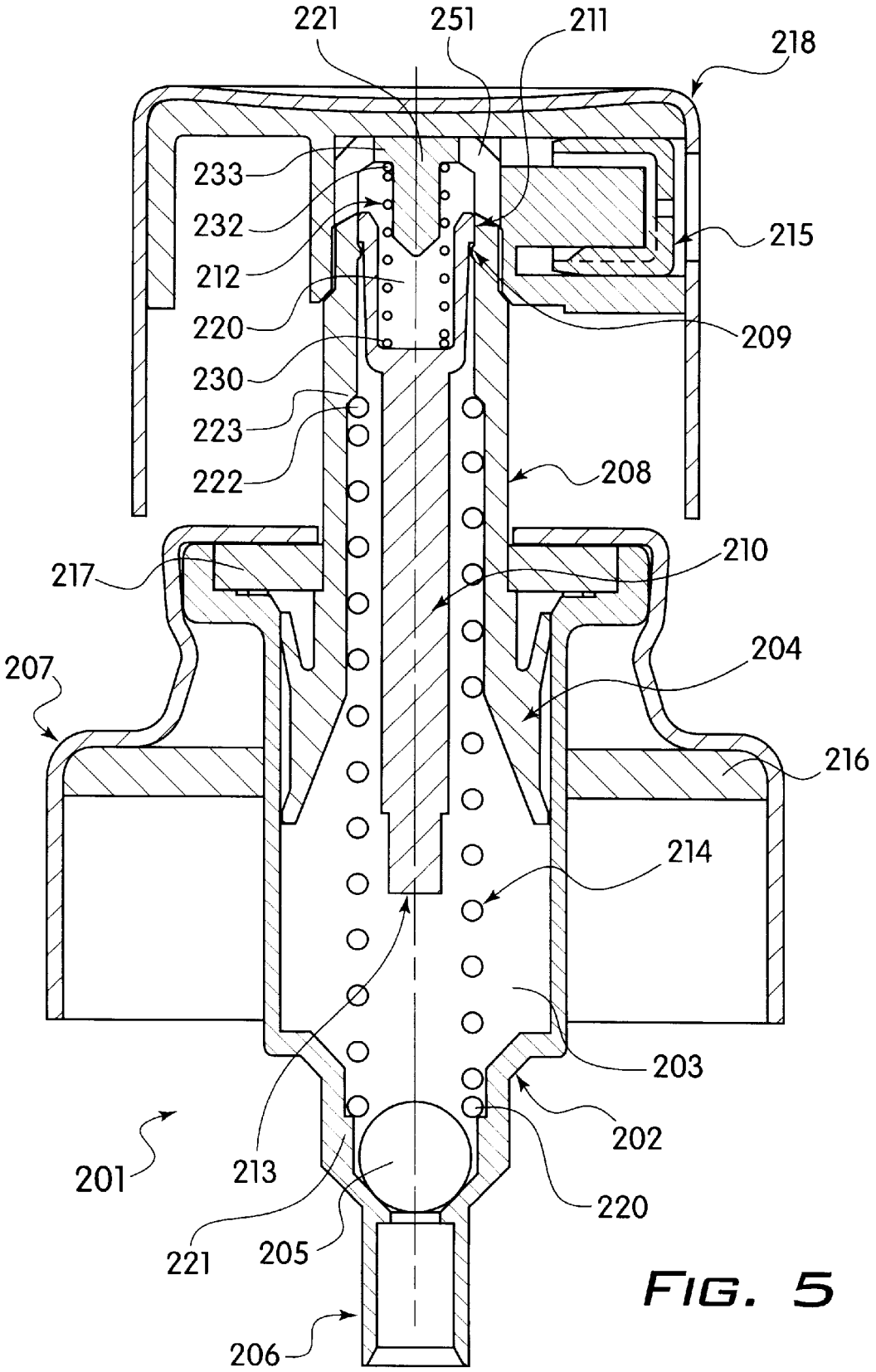
FIG. 5 is a cross-sectional view of a third embodiment of a pump dispenser of the present invention, in a non-depressed position.
Figure 6:
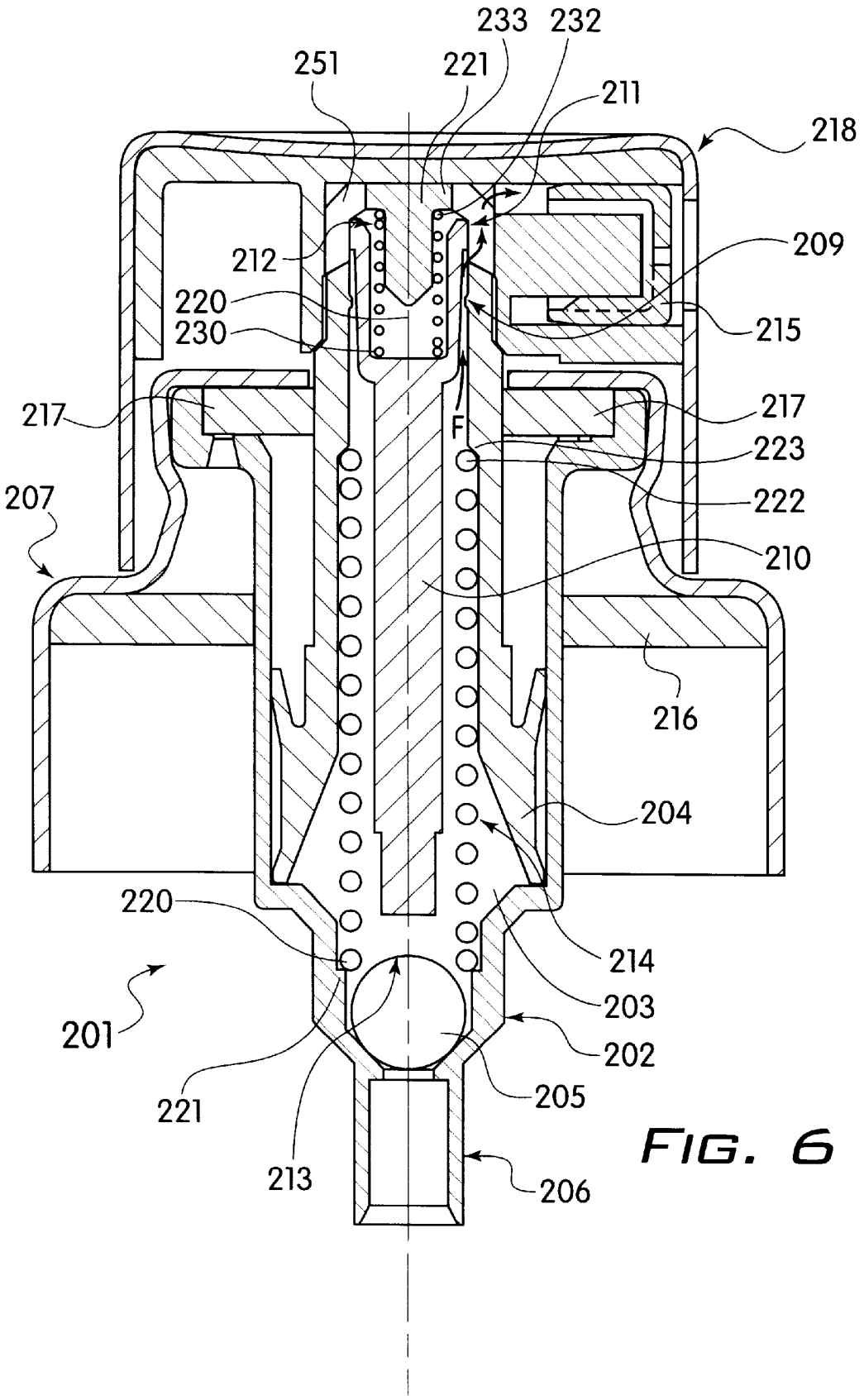
FIG. 6 is the embodiment of FIG. 5 in the depressed position at the bottom of the pump stroke.

FIGS. 5 and 6 show a third embodiment of the pump of the present invention. The design of the pump 201 of the embodiment of FIGS. 5 and 6 is very similar to that of the embodiment of FIGS. 1 and 2, except that the design of the upper end of the outlet valve 210 is different. The outlet valve 210 of FIGS. 5 and 6 includes an opening 220 into which valve spring 212 is received, and pump piston 204 includes a pin 221 for receiving the other end of valve spring 212. The bottom of opening 220 acts as a spring seat for the lower or axially-inward end 230 of valve spring 212, and upper end 232 of valve spring 212 engages a spring seat 233. The valve sealing flange 211 of the embodiment of FIGS. 5 and 6 is not conically shaped, and the valve sealing flange 211 interacts with a rounded piston sealing flange 209 to form a seal for the outlet valve 210. A spring seat 223 restrains the upper or axially-outward end 222 of pump spring 214. The valve sealing flange 211 seals against the interior wall of the pump piston 204. A series of axial slots 251, which provide a fluid bypass around valve sealing flange 211, are in pump piston 204 upper end. In all other respects, however, the embodiment of FIGS. 1 and 2 and FIGS. 5 and 6 are identical in structure and operation. Similar elements in the embodiment of FIGS. 5 and 6 are designated with identical reference numerals to those used with the embodiment of FIGS. 1 and 2, except for the addition of the "200" prefix in the embodiment of FIGS. 5 and 6.

In operation of the embodiment of FIGS. 5 and 6, finger pressure on spray head 218 is applied to the pump in the non-depressed condition shown in FIG. 5. Downward, or axially-inward, movement of spray head 218 causes pump piston 204 to compress the fluid within pump chamber 203. When sufficient pressure has built up within pump chamber 203 as a result of downward movement of pump piston 204, this pressure will act on the downwardly or axially-inwardly facing surfaces on outlet valve 210 to overcome the bias of valve spring 212, thereby pushing outlet valve 210 up until the valve sealing flange 211 lifts from the piston sealing flange 209 and clears the lower end of slots 251. After valve sealing flange 211 clears slots 251, pressurized fluid can escape through slots 251 around valve sealing flange 211, and thereafter out of spray nozzle 215. The outlet valve 210 will remain open throughout the downward, or axially-inward, movement of pump piston 204, as long as sufficient pressure in maintained within pump chamber 203 to overcome the biasing force of valve spring 212.

FIG. 6 shows the pump 201 of FIG. 5 at the bottom of the pump stroke. In this position, the outlet valve engagement end 213 of outlet valve 210 contacts the upper end of inlet valve 205. As inlet valve 205 is, in this position, seated against the bottom of pump housing 202, engagement of outlet valve engagement end 213 and inlet valve 205 causes piston sealing flange 209 and valve sealing flange 211 to disengage from one another and for valve sealing flange 211 to move past the bottom end of slots 251, against the bias of valve spring 212, thereby allowing any trapped air or liquid within pump chamber 203 to flow out of pump chamber 203 and out spray nozzle 215. The flow of air or liquid out of pump chamber 203 is indicated by arrows F.

After the pump 201 is in the position shown in FIG. 6, finger pressure is released from spray head 218. Piston spring 214 biases pump piston 204 upwardly, increasing the volume of pump chamber 203 and thereby decreasing the pressure in pump chamber 203. As a result, outlet valve 210 closes, as the bias of valve spring 212 causes valve sealing flange 211 to seal against piston sealing flange 209. Inlet valve 205 opens, as the decreased pressure in pump chamber 203 unseats inlet valve 205 against the force of gravity, allowing liquid to be drawn into pump chamber 203 through inlet tube 206 and any attached dip tube (not shown). Pump chamber 203 fills, and pump piston 204 continues to move upwardly, until it reaches the position shown in FIG. 5.

Figure 7:
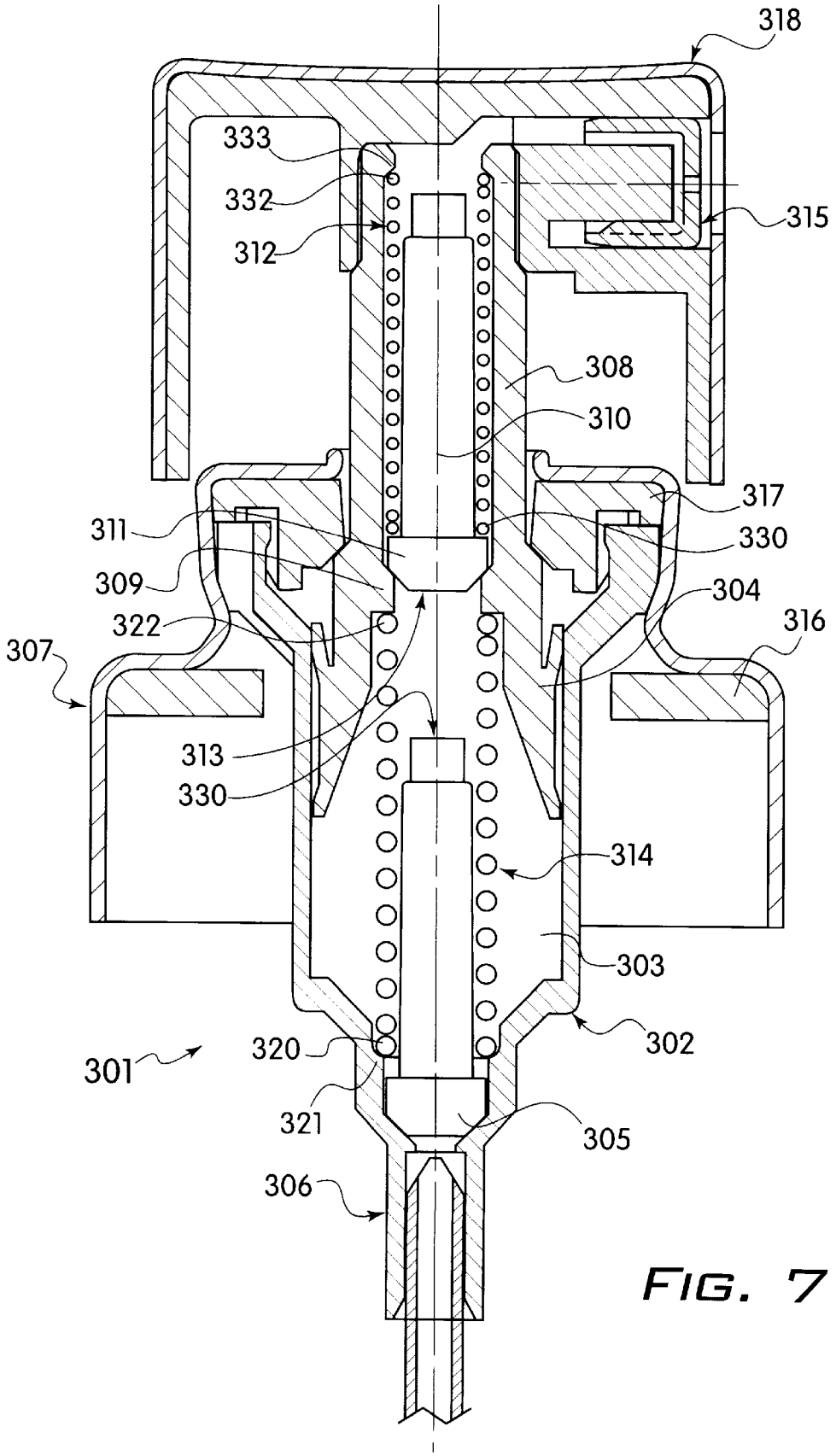
FIG. 7 is a cross-sectional view of a fourth embodiment of a pump dispenser of the present invention, in a non-depressed position.

FIG. 7 shows a fourth embodiment of the pump of the present invention. In this embodiment, similar elements to those in the embodiment of FIGS. 1 and 2 are designated with identical reference numerals to those used with the embodiment of FIGS. 1 and 2, except for the addition of the "300" prefix in the embodiment of FIG. 7. In the embodiment of FIG. 7, the inlet valve 305 is a gravity-biased stem valve. Inlet valve 305 includes an inlet valve engagement end 330, which engages with outlet valve engagement end 313 on outlet valve 310 when the pump piston 304 is at the bottom of its stroke. This engagement disengages valve engagement flange 311 from piston engagement flange 309, releasing air or liquid from pump chamber 303 so that it may flow through spray nozzle 315. In all other respects, the structure and operation of the embodiment of FIG. 7 is identical to that of the embodiment of FIGS. 1 and 2.

Figure 8:
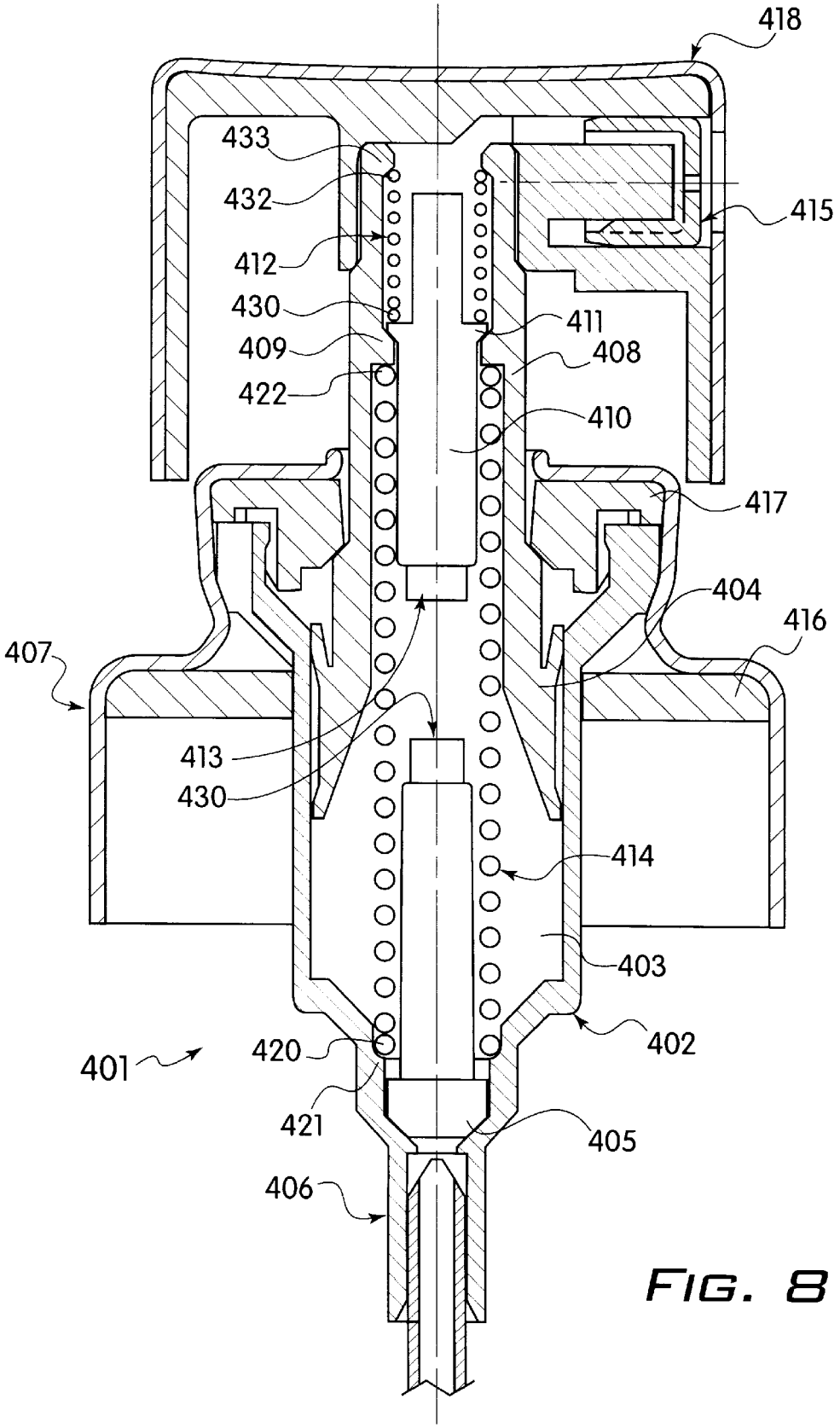
FIG. 8 is a cross-sectional view of a fifth embodiment of a pump dispenser of the present invention, in a non-depressed position.

FIG. 8 shows a fifth embodiment of the pump of the present invention, which is similar in design and operation to the embodiment of FIG. 7, but which uses an outlet valve 410 and piston sealing flange 409 similar in design to those used in the embodiment of FIGS. 1 and 2. In all other respects, however, the embodiment of FIG. 8, in design and operation, is identical to that of the embodiment of FIG. 7. In the embodiment of FIG. 8, elements similar to those in the embodiment of FIG. 7 include identical reference numerals, except in the embodiment of FIG. 8 a "400" prefix is used instead of the "300" prefix of FIG. 7.

Figure 9:
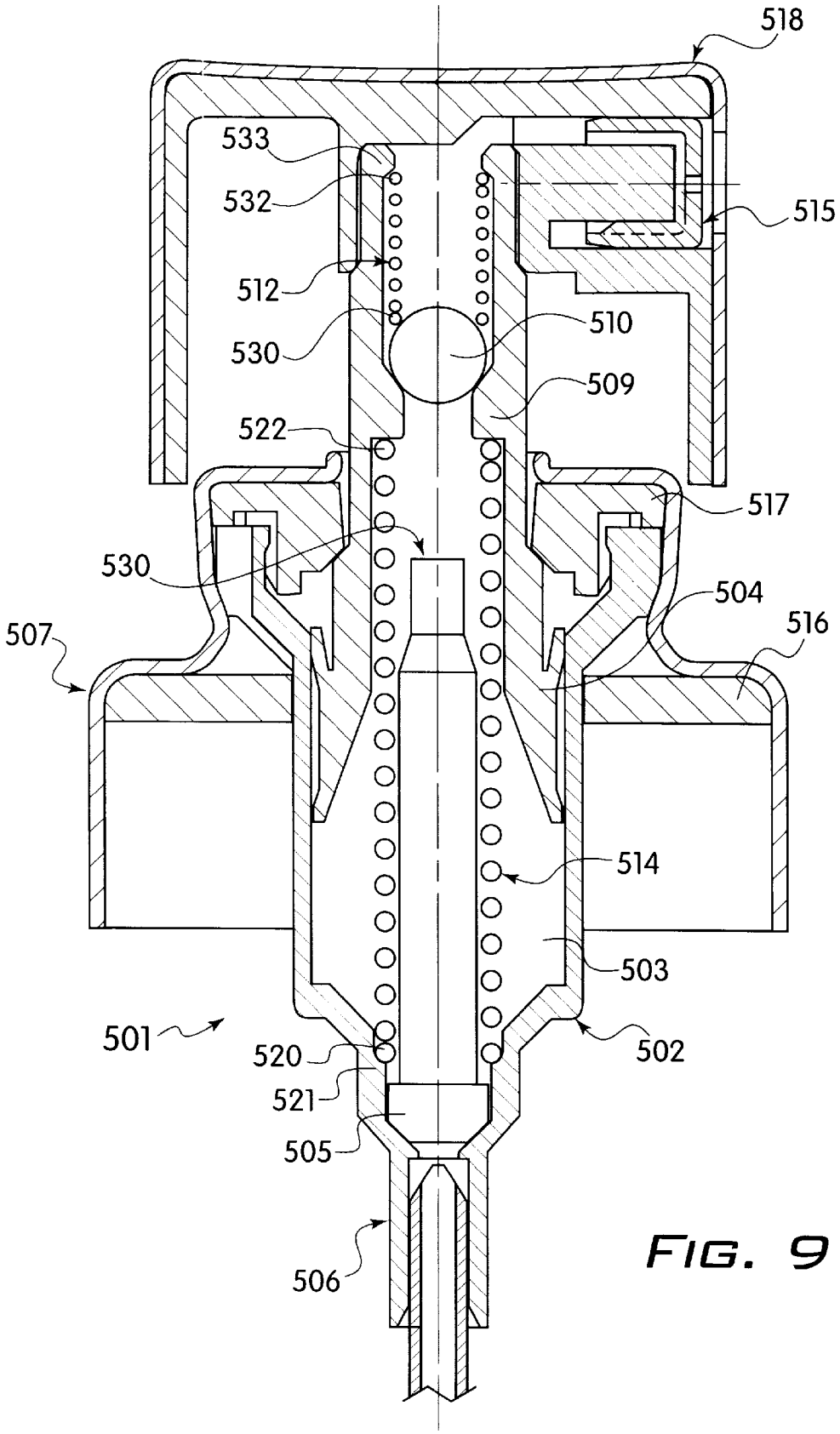
FIG. 9 is a cross-sectional view of a sixth embodiment of a pump dispenser of the present invention, in a non-depressed position.

FIG. 9 shows a sixth embodiment of the pump of the present invention, which is similar in design and operation to the embodiment of FIG. 7, but which uses a spring-biased ball-check inlet valve 510 which seals against piston sealing flange 509. At the bottom of the pump stroke, the inlet valve engagement end 530 of inlet valve 505 engages the bottom of outlet valve 510, disengaging outlet valve 510 from piston sealing flange 509, thereby allowing air and liquid in pump chamber 503 to escape out spray nozzle 515. In all other respects, the embodiment of FIG. 9 operates in a manner identical to that of the embodiment of FIG. 7. The embodiment of FIG. 9 uses the prefix "500" for those elements that are similar to those elements designated with the prefix "300" in the embodiment of FIG. 7.

Figure 10:
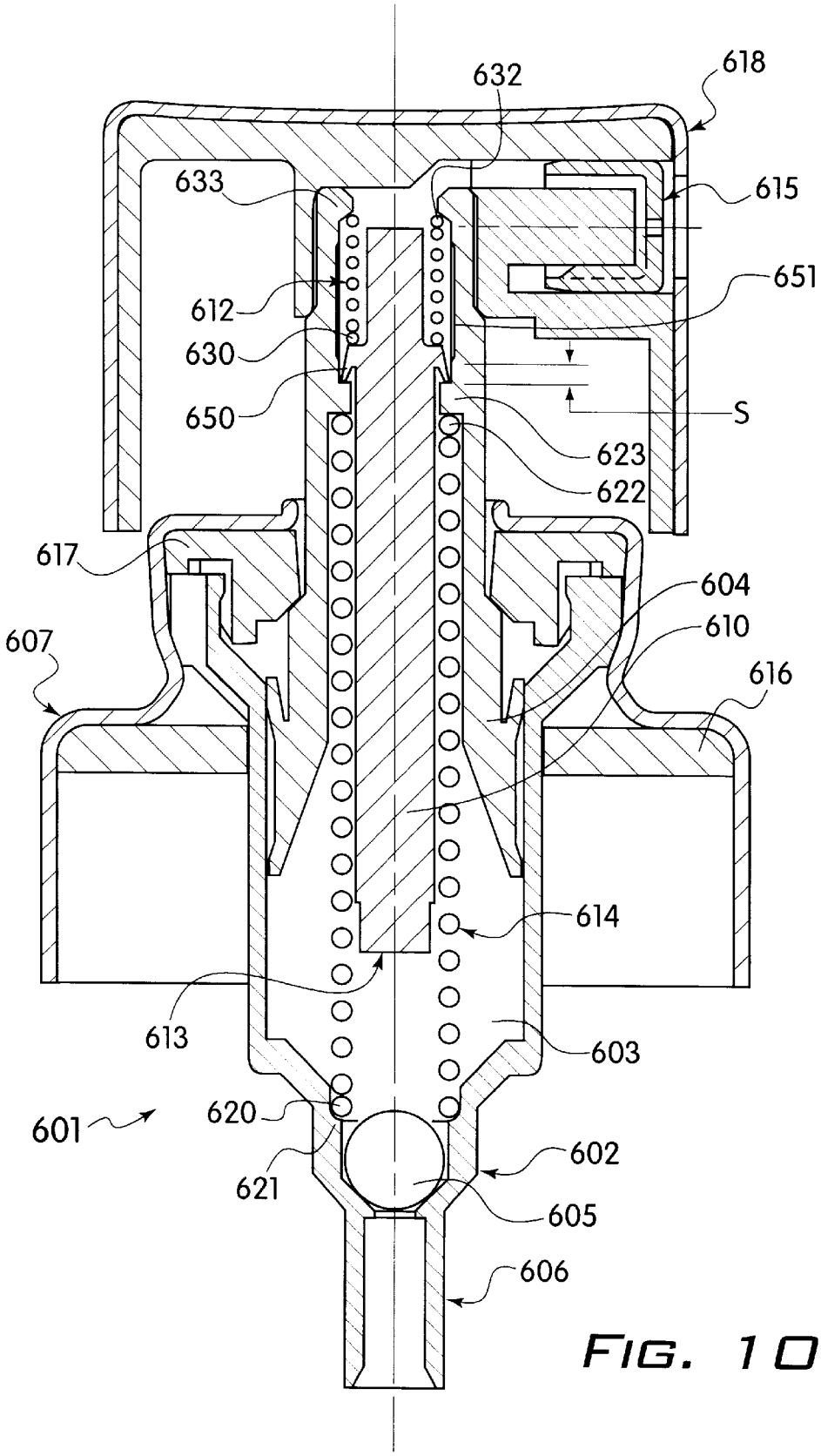
FIG. 10 is a cross-sectional view of a seventh embodiment of a pump dispenser of the present invention, in a non-depressed position.

FIG. 10 shows a seventh embodiment of the pump of the present invention. The design of the pump 601 of the embodiment of FIG. 10 is similar to that of the embodiment of FIGS. 5 and 6, except that the design of the upper end of the outlet valve 610 is different. The outlet valve 610 of FIG. 10 includes a sealing skirt 650. The top of sealing skirt 650 acts as a spring seat for the lower or axially-inward end 630 of valve spring 612, and upper end 632 of valve spring 612 engages spring seat 633. The sealing skirt 650 of the embodiment of FIG. 10 seals against the interior wall of the pump piston 604. Along the distance S, the sealing skirt 650 seals around its entire periphery. Above the distance S are a series of axial slots 651, which provide a fluid bypass around sealing skirt 650 when sealing skirt 650 is above the lower end of slots 651. Similar elements in the embodiment of FIG. 10 are designated with identical reference numerals to those used with the embodiment of FIGS. 5 and 6, except for the addition of the "600" prefix in the embodiment of FIG. 10.

In operation of the embodiment of FIG. 10, finger pressure on spray head 618 is applied to the pump in the non-depressed condition shown in FIG. 10. Downward, or axially-inward, movement of spray head 618 causes pump piston 604 to compress the fluid within pump chamber 603. When sufficient pressure has built up within pump chamber 603 as a result of downward movement of pump piston 604, this pressure will act on the downwardly or axially-inwardly facing surfaces on outlet valve 610 to overcome the bias of valve spring 612, thereby pushing outlet valve 610 up until the sealing skirt 650 clears the lower end of slots 651. After sealing skirt 650 clears slots 651, pressurized fluid can escape through slots 651 around sealing skirt 650, and thereafter out of spray nozzle 615. The outlet valve 610 will remain open throughout the downward, or axially-inward, movement of pump piston 604, as long as sufficient pressure in maintained within pump chamber 603 to overcome the biasing force of valve spring 612. The remaining operation of the embodiment of FIG. 10 is identical to the operation of the embodiment of FIGS. 5 and 6.

Figure 11:
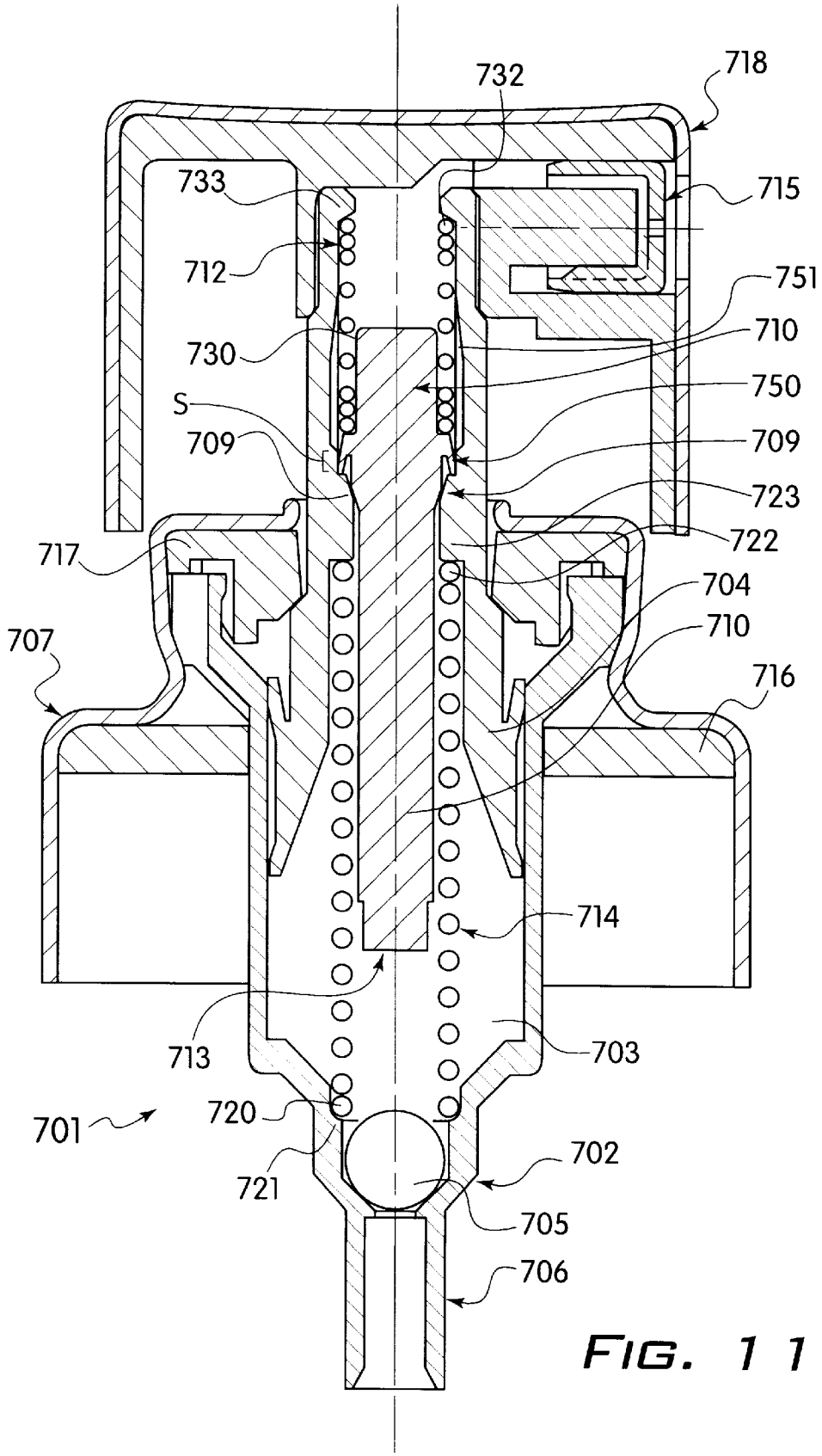
FIG. 11 is a cross-sectional view of an eighth embodiment of a pump dispenser of the present invention, in a non-depressed position.

FIG. 11 shows an eighth embodiment of the pump of the present invention. The design of the pump 701 of the embodiment of FIG. 11 is very similar to that of the embodiments of FIGS. 10 and 2, except the embodiment of FIG. 11 includes conical sealing surfaces on piston sealing flange 709 and valve 210, similar to the conical sealing surfaces in the embodiments of FIGS. 1–4 and 7–8. It has been found that this embodiment provides particularly advantageous results, in that the pressure to disengage the conical sealing surfaces on piston sealing flange 709 and valve 710 is greater than the pressure necessary to move the sealing skirt 750 upward by a multiple of 2 to 10—depending on the angle of the conical surfaces and the diameters of the conical surfaces on the piston and on the stem. As a result, upon actuation of the pump, the pressure which is placed on the sealing skirt 750 at the moment the conical sealing surfaces disengage is much more than is necessary to push the valve 710 up, thereby rapidly opening the outlet valve and providing a more uniform exit pressure and better spray dispersion. This result is preferred by consumers. The use of the conical sealing surfaces also ensures that a lighter valve spring 712 may be used. The remainder of the operation of the embodiment of FIG. 11 is identical to the operation of the embodiment of FIG. 10. Similar elements in the embodiment of FIG. 11 are designated with identical reference numerals to those used with the embodiment of FIG. 10, except for the addition of the "700" prefix in the embodiment of FIG. 11.

Figure 12:
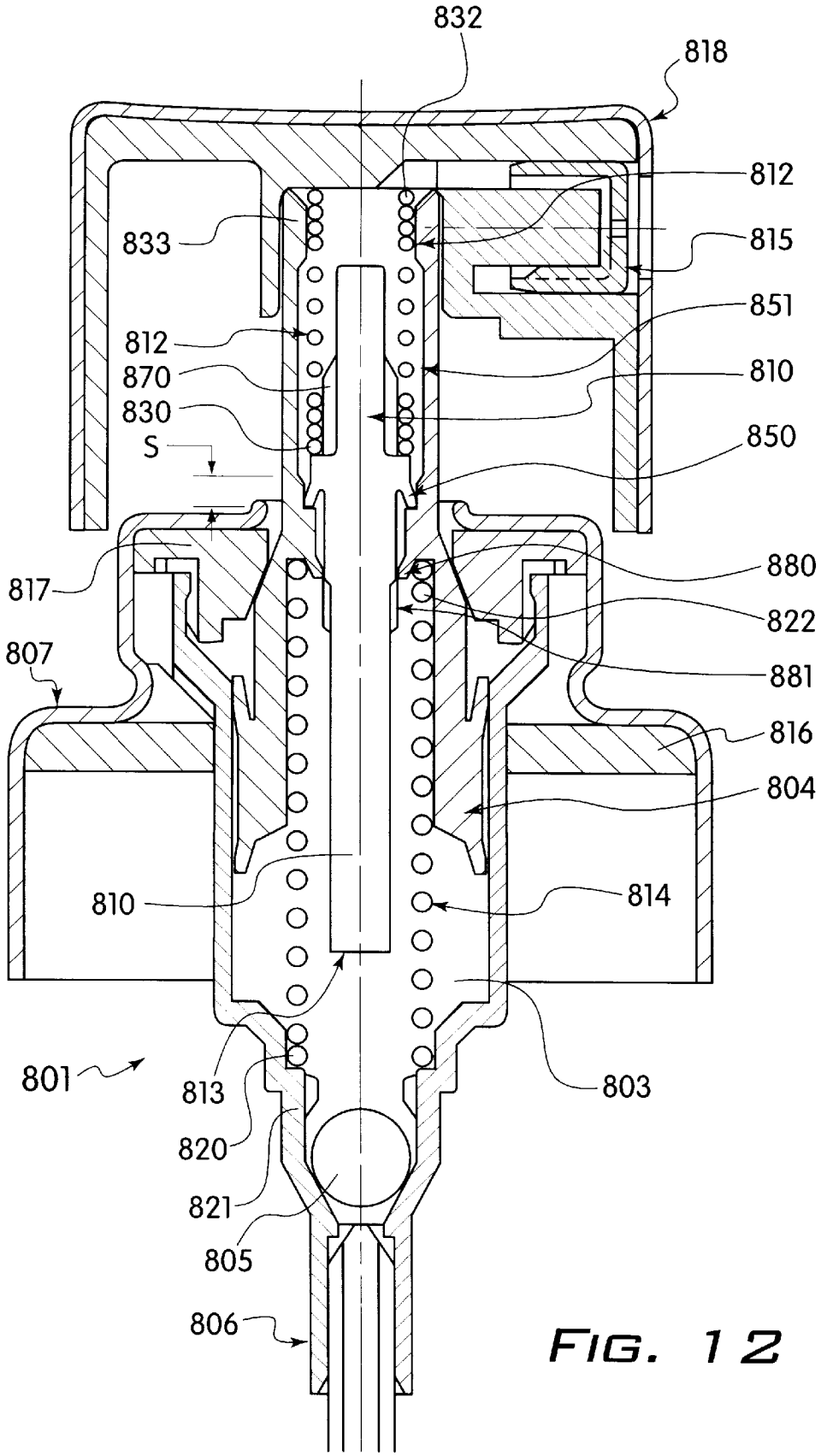
FIG. 12 is a cross-sectional view of a ninth embodiment of a pump dispenser of the present invention, in a non-depressed position.

FIG. 12 shows a ninth embodiment of the present invention. The design of the pump of the embodiment of FIG. 12 is very similar to that of the embodiment of FIG. 11, except in the design of the interface between the valve 810 and the pump piston 804. In the embodiment of FIG. 12, the outlet valve 810 includes a sealing skirt 850. The top of sealing skirt 850 acts as a spring seat for the lower or axially-inward end 830 of valve spring 812, and upper end 832 of valve spring 812 interacts with spring seat 833. The valve spring 812 of the embodiment of FIG. 12 includes several "dead coils"—i.e., coils which touch an adjacent coil on its upper and lower surfaces—at both the upper end 832 and the lower end 830. This type of valve spring 812 provides several advantages. First, the valve spring 812 with dead coils reduces tangling of springs when used in high-speed automatic assembly equipment. Second, the dead coils provide a rigid metallic column at the top and bottom of valve spring 812. In addition, the spring seat 833 of pump piston 804 can be made to have an inner diameter which is equal to the outer diameter of the valve spring 812. As a result, when the spray head 818 is assembled onto the pump piston 804 the piston, specifically spring seat 833, is squeezed between the rigid steel column and the inner diameter of the actuator, resulting in good retention of these parts. As a result, the piston top can be made of thinner and softer materials, giving greater design flexibility and increasing the ability of the pump piston 804 to seal.

The sealing skirt 850 of the embodiment of FIG. 12 seals against the interior wall of the pump piston 804. Along the distance S, the sealing skirt 850 seals around its entire periphery. Above the distance S is a widened-diameter section 851, which provides a fluid bypass around sealing skirt 850 when sealing skirt 850 is above the lower end of widened-diameter section 851. Widened diameter section 851 could alternatively be a series of axial slots. In addition, a stem sealing skirt 880 on pump piston 804 seals against the outer diameter of the outlet valve 810. Outlet valve 810 includes a series of axial valve slots 881. After the axial valve slots 881 pass through stem sealing skirt 880, fluid communication is established between the pump chamber 803 and the sealing skirt 850. After this is accomplished, the embodiment of FIG. 12 operates in a manner identical to the operation of the embodiment of FIG. 11. The embodiment of FIG. 12 provides the same advantageous performance results as the embodiment of FIG. 11, but is easier to tolerance, mold, and assemble in high volume. Similar elements in the embodiment of FIG. 12 are designated with identical reference numerals to those used with the embodiment of FIG. 11, except for the addition of the "800" prefix in the embodiment of FIG. 12.

Figure 13:
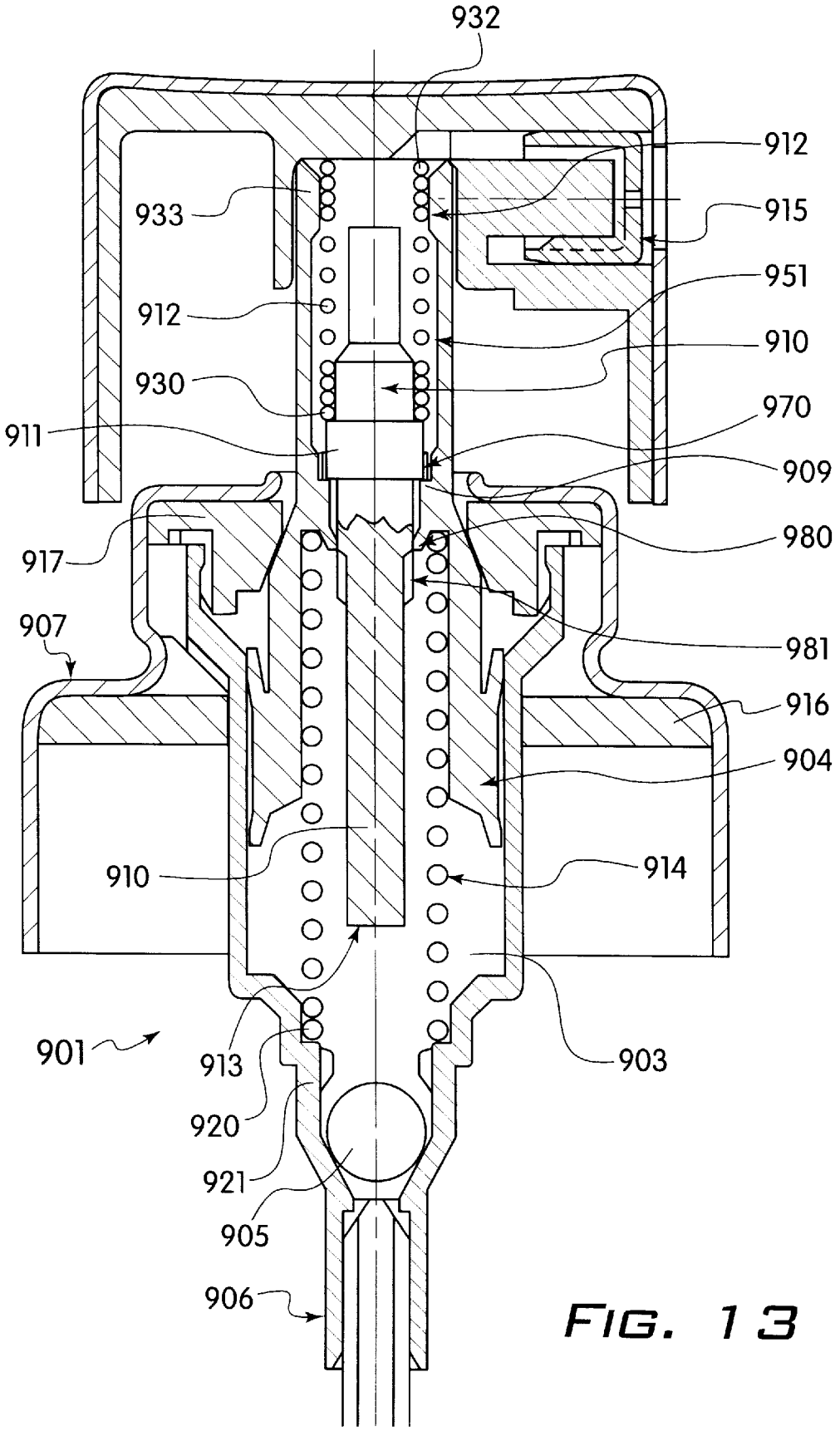
FIG. 13 is a cross-sectional view of a tenth embodiment of a pump dispenser of the present invention, in a non-depressed position.

FIG. 13 shows a tenth embodiment of the present invention. The design of the pump of the embodiment of FIG. 13 is very similar to that of the embodiment of FIG. 12, except in the design of the upper portion of the valve 910. Valve 910 includes a valve sealing flange 911 which is structured so that its radially-outward edge is spaced from the radially-inward surface of pump piston 904. Valve sealing flange 911 seats against a piston sealing flange 909, thereby sealing spray nozzle 915 from pump chamber 903. Downward, or axially-inward, movement of spray head 918 causes pump piston 904 to compress the fluid within pump chamber 903. When sufficient pressure has built up within pump chamber 903 as a result of downward movement of pump piston 904, this pressure will act on the downwardly or axially-inwardly facing surfaces on outlet valve 910 to overcome the bias of valve spring 912, thereby unseating outlet valve 910 by moving the axial valve slots 981 past the stem sealing skirt 980 and disengaging the sealing surfaces on piston sealing flange 909 and valve sealing flange 911. The resulting passages though axial valve slots 981, the gap between the surfaces on piston sealing flange 909 and valve sealing flange 911 and slots 970 in valve sealing flange allow pressurized fluid to flow out of pump chamber 903, and thereafter out of spray nozzle 915. A widened diameter section or axial slots 951 can also be provided to allow passage of fluid from the pump chamber 903 to the spray nozzle 915.

Figure 14:
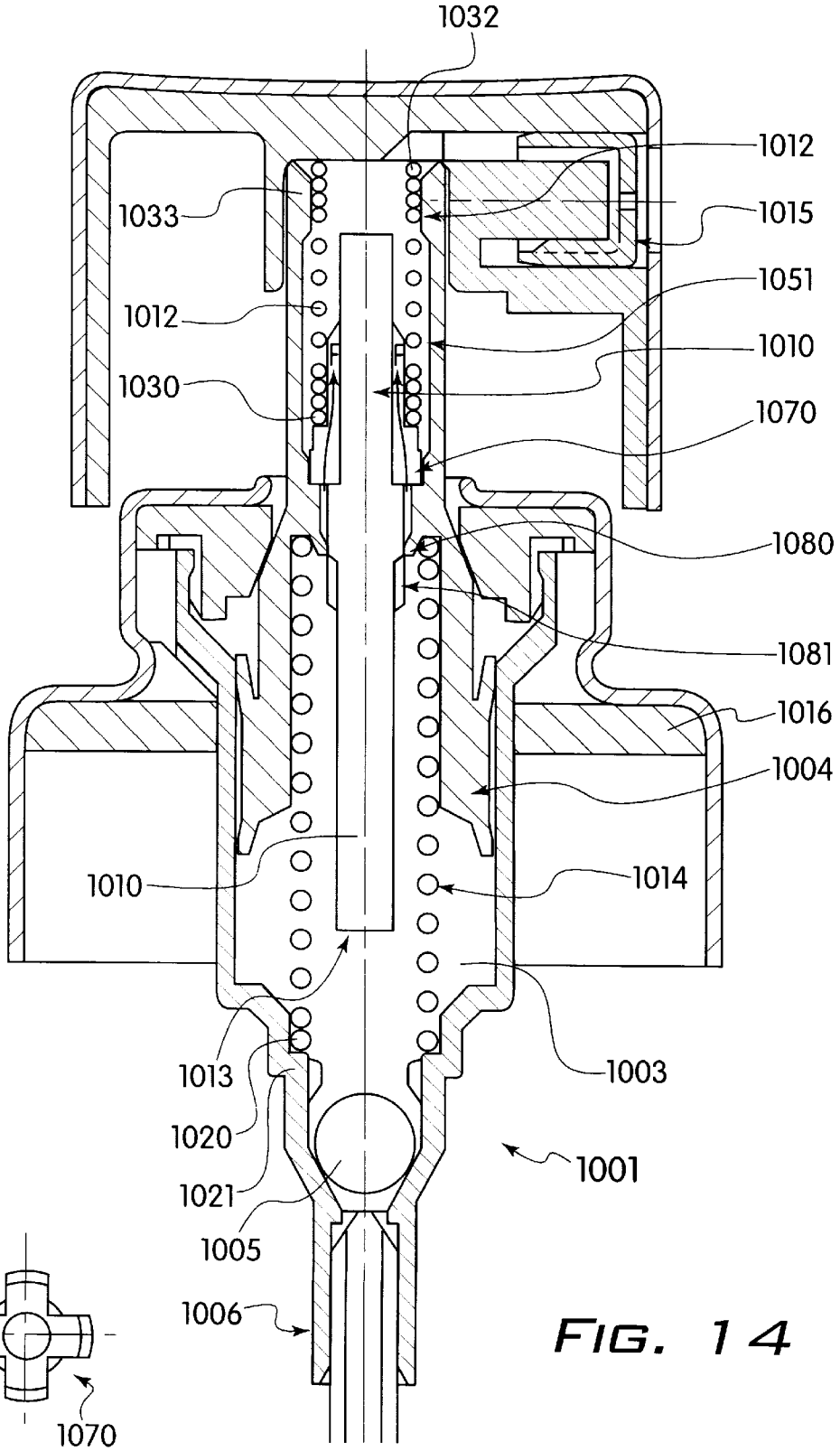
FIG. 14 is a cross-sectional view of an eleventh embodiment of a pump dispenser of the present invention, in a non-depressed position.
Figure 14A:
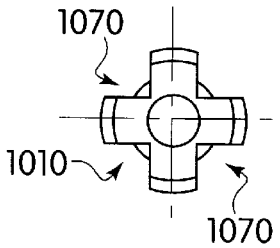
FIG. 14*a* is a top view of the stem valve of the embodiment of FIG. 14.

FIG. 14 shows a different configuration of the embodiment of FIG. 13. In the embodiment of FIG. 14, the flange 1011 does not create a seal against the flange 1009. The slots 1070 in outlet valve 1010 bridge the flange 1011, creating a flow path around flange 1011 even when flange 1011 is seated against flange 1009. In all other respects, however, the embodiments of FIG. 13 and FIG. 14 are identical in structure in operation. FIG. 14*a* shows a top view of the upper portion of outlet valve 1010, and specifically the configuration of the slots 1070.

Figure 15:
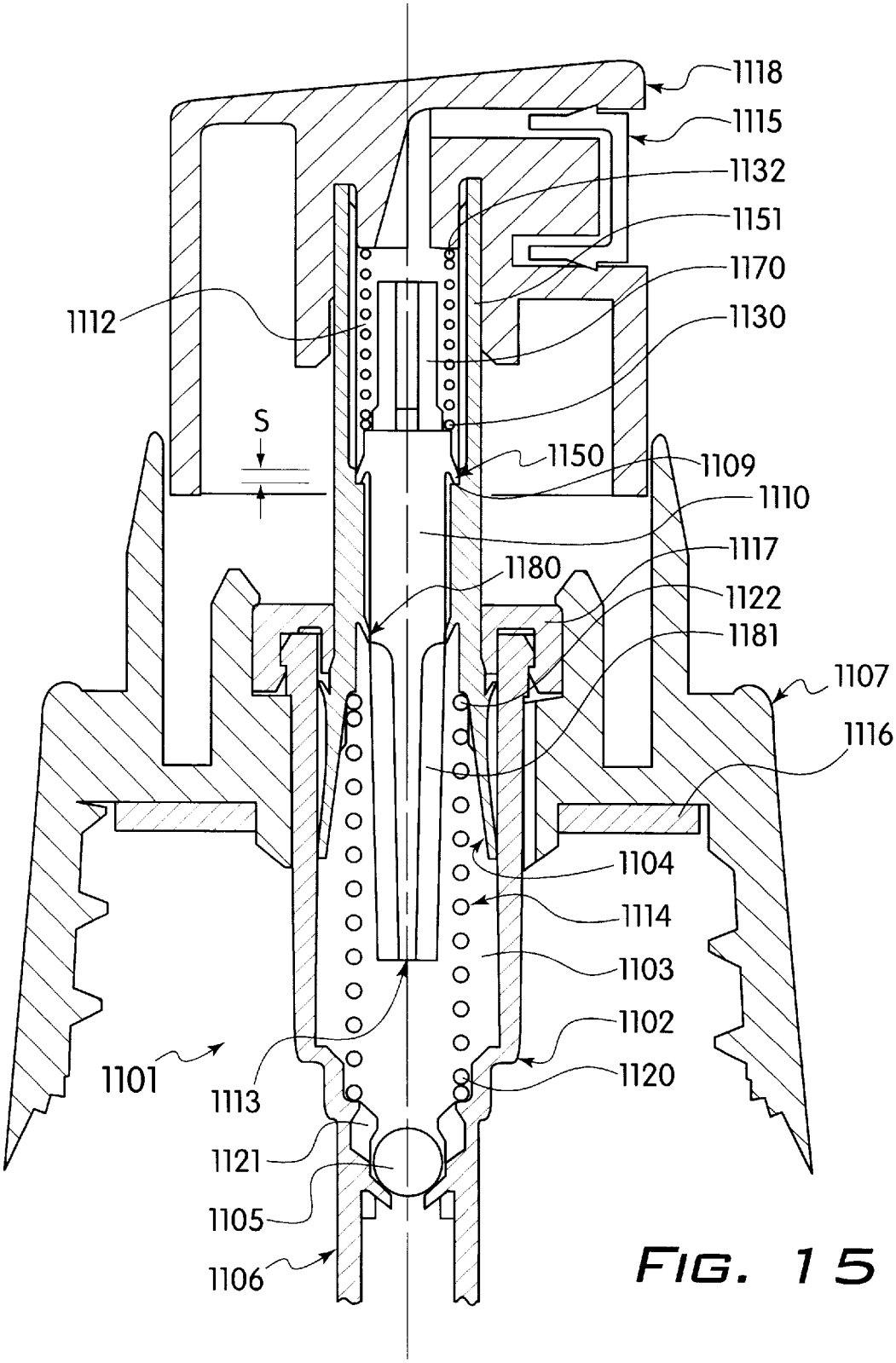
FIG. 15 is a cross-sectional view of a twelfth embodiment of a pump dispenser of the present invention, in a non-depressed position.

FIG. 15 shows a twelfth embodiment of the present invention. The design of the pump of the embodiment of FIG. 15 is very similar to that of the embodiment of FIG. 12, except in the design of the interface between the valve 1110 and the pump piston 1104. In the embodiment of FIG. 15, the outlet valve 1110 includes a sealing skirt 1150. The top of sealing skirt 1150 acts as a spring seat for the lower or axially-inward end 1130 of valve spring 1112, and upper end 1132 of valve spring 1112 interacts with the actuator 1118. The bottom of sealing skirt 1150 engages and seals against a seat 1109 in the lowermost or axially-inwardmost position. The valve spring 1112 of the embodiment of FIG. 15 can include "dead coils"—i.e., coils which touch an adjacent coil on its upper and lower surfaces—at both the upper end 1132 and the lower end 1130.

The sealing skirt 1150 of the embodiment of FIG. 15 seals against the interior wall of the pump piston 1104. Along the distance S, the sealing skirt 1150 seals around its entire periphery. Above the distance S are a series of slots 1151, which provides a fluid bypass around sealing skirt 1150 when sealing skirt 1150 is above the lower end of slots 1151. In addition, a stem sealing skirt 1180 on pump piston 1104 seals against the outer diameter of the outlet valve 1110. Outlet valve 1110 includes a series of axial valve slots 1181. After the axial valve slots 1181 pass through stem sealing skirt 1180, fluid communication is established between the pump chamber 1103 and the sealing skirt 1150. After this is accomplished, the embodiment of FIG. 15 operates in a manner identical to the operation of the embodiment of FIG. 12. Similar elements in the embodiment of FIG. 15 are designated with identical reference numerals to those used with the embodiment of FIG. 12, except for the addition of the "1100" prefix in the embodiment of FIG. 15.

Figure 16:
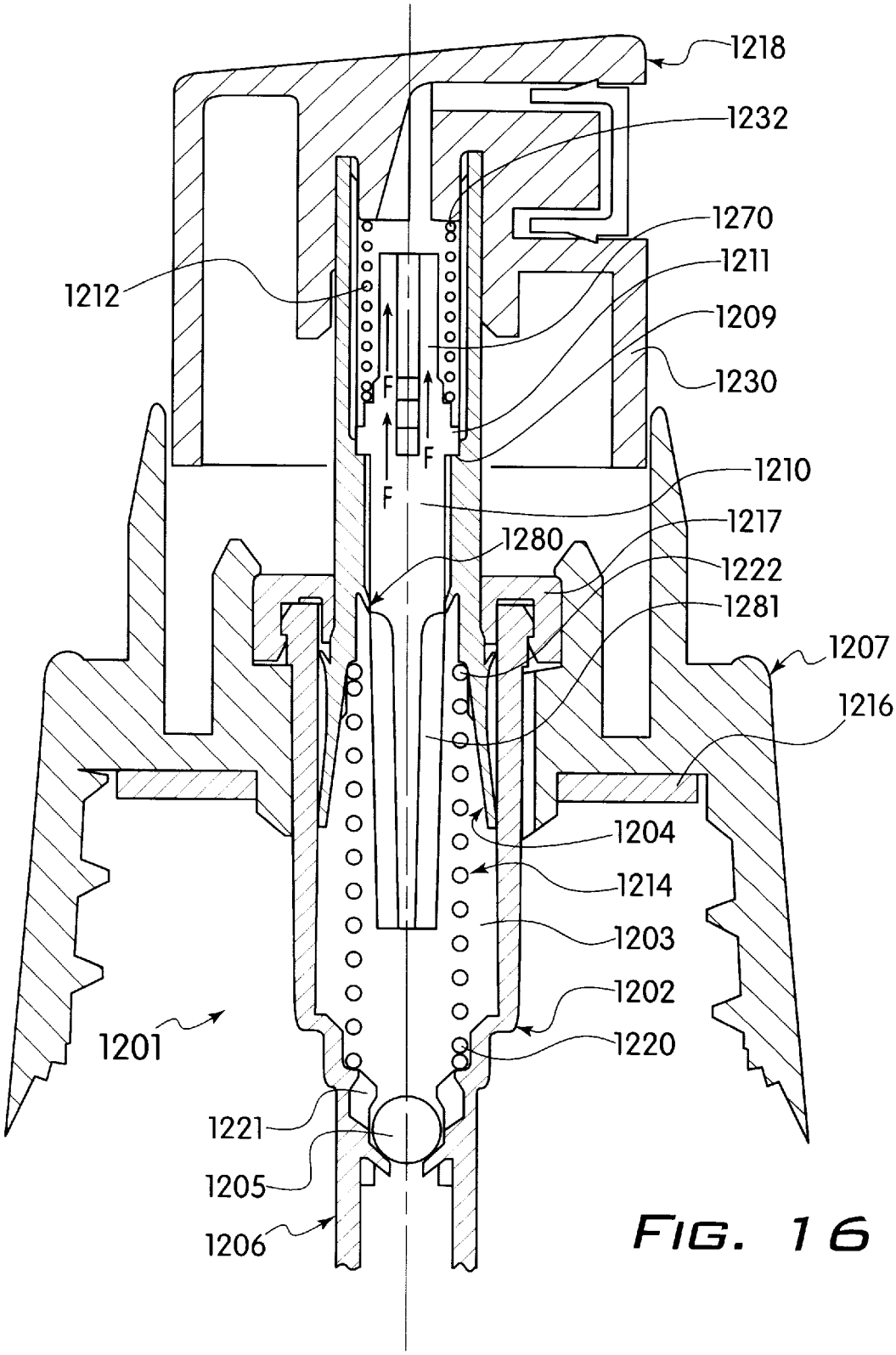
FIG. 16 is a cross-sectional view of an thirteenth embodiment of a pump dispenser of the present invention, in a non-depressed position.

FIG. 16 shows a different configuration of the embodiment of FIG. 14. In the embodiment of FIG. 16, the flange 1211 does not create a seal against the flange 1209. The slots 1270 in outlet valve 1210 bridge the flange 1211, creating flow paths F around flange 1211 even when flange 1211 is seated against flange 1209. In the embodiment of FIG. 16, the top 1232 of spring 1212 seats against actuator 1218. The embodiment of FIG. 16, like the embodiment of FIG. 14, is particularly useful for thicker liquid products, as these embodiments do not require that two seals be bypassed by the exiting liquid product.

Both the embodiments of FIGS. 15 and 16 are shown using a screwcap 1107, 1207 for mounting to a container, and therefore may be used in larger dosage size applications. A retaining element 1117, 1217 is used to retain the pump components within the screwcap 1107, 1207. The retaining element 1117, 1217 allows the pump to be assembled by pushing the pump components down into the screwcap 1107, 1207. In the embodiments of FIGS. 15 and 16, the retention of the spring 1112, 1212 against the actuator 1118, 1218 increases the ease by which the pump may be assembled.

In each of the embodiments in FIGS. 1–16, both the inlet and outlet valves for the pump chamber are retained in their sealing positions only by the force of gravity or the force of a spring bias. In the embodiments of FIGS. 1–16, no frictional or other forces caused by interaction of the two sealing parts are used to effect the outlet valve seal, and disengagement of the seal is only effected by the pressure of fluid within the pump chamber. Although the embodiments of FIGS. 5–6, 10–12 and 15–16 include interacting sealing surfaces at the outlet valve which slide relative to one another, the forces between these surfaces are uniform throughout the movement of the valve, and do not vary depending on the position of the valve. This design ensures that the parts need not be closely toleranced to ensure good sealing or that tolerance variations do not materially affect pump performance characteristics. As a result the pump of the present invention is much easier to manufacture, while providing advantageous operational characteristics and long-term reliability. Furthermore, in each of the embodiments of FIGS. 1–16, the inlet valve is spaced from, and does not interact with, the pump piston, thereby ensuring that it operates only in response to the force of gravity or pressure within the pump chamber. As a result, much more reliable operation of the inlet valve can be assured. Finally, since the pump spring surrounds the inlet valve, the pump spring acts to both align, and act as a valve cage, for the inlet valve.

While the forgoing represents a description of several preferred embodiments, it is to be understood that the claims below recite the features of the present invention, and that other embodiments, not specifically described hereinabove, fall within the scope of the present invention.

What is claimed is:

1. A pump comprising:

a pump housing defining a pump chamber, the pump housing including an inlet opening, the pump housing further including a first inlet sealing surface;

a pump piston reciprocable in the pump housing in a first, axially-inward direction and a second, axially-outward direction, reciprocation in the first direction terminating at a first location at the bottom of a stroke of the pump piston, the pump piston including an outlet opening, the pump piston further including a first outlet sealing surface;

a piston spring biasing the pump piston in the second direction;

an inlet valve including a second inlet sealing surface, the second inlet sealing surface engaging the first inlet sealing surface to thereby close the inlet opening, the inlet valve being spaced from, and not contacting, the pump piston;

an outlet valve including a second outlet sealing surface, the second outlet sealing surface engaging the first outlet sealing surface to thereby close the outlet opening, wherein an axially outer end of the inlet valve cooperates with an axially inner end of the outlet valve, to thereby open the outlet opening when the pump piston is at the first location; and an outlet valve spring biasing the outlet valve to close the outlet opening.

2. The pump of claim 1, wherein:

the inlet valve is a ball valve.

3. The pump of claim 1, wherein:

the outlet valve is a stem valve.

4. The pump of claim 3, wherein:

the outlet valve includes an outlet valve engagement end engaging the inlet valve at the first location.

5. The pump of claim 1, wherein:

the outlet valve includes a valve sealing flange, the pump piston includes a piston sealing flange, the valve sealing flange and the piston sealing flange cooperating to close the outlet opening.

6. The pump of claim 5, wherein:

the valve sealing flange includes a conical sealing surface and the piston sealing flange includes a conical sealing surface.

7. The pump of claim 1, wherein:

the inlet valve is a stem valve.

8. The pump of claim 7, wherein:

the inlet valve includes an inlet valve engagement end engaging the outlet valve at the first location.

9. The pump of claim 7, wherein:

the inlet valve includes an inlet valve engagement end and the outlet valve includes an outlet valve engagement end, the inlet valve engagement end engaging the outlet valve engagement end at the first location.

10. The pump of claim 1, wherein:

the outlet valve includes a ball-check valve.

11. The pump of claim 1, wherein:

the inlet valve includes an inlet valve engagement end engaging the outlet valve at the first location.

12. The pump of claim 1, wherein:

the first outlet sealing surface engages the second outlet sealing surface non-frictionally.

13. The pump of claim 1, wherein:

the outlet valve includes an opening and the pump piston includes a pin, the opening receiving one end of the valve spring and the pin receiving an opposite end of the valve spring.

14. The pump of claim 5, wherein:

the piston sealing flange is rounded.

15. The pump of claim 1, wherein:

the outlet valve including a sealing skirt, the pump piston including at least one axial slot, the at least one axial slot providing a bypass for fluid around the sealing skirt in an axially-outward position of the outlet valve.

16. The pump of claim 15, wherein:

the outlet valve includes a valve sealing flange, the pump piston includes a piston sealing flange, the valve sealing flange and the piston sealing flange cooperating to close the outlet opening.

17. The pump of claim 15, wherein:

the outlet valve includes at least one axial valve slot, the pump piston includes a piston sealing skirt, the at least one axial valve slot providing a bypass for fluid around the piston sealing skirt in an axially-outward position of the outlet valve.

18. The pump of claim 1, wherein:

the outlet valve spring includes dead coils at at least one end of the outlet valve spring.

19. The pump of claim 18, wherein:

the outlet valve spring includes dead coils at an axially-outward end of the outlet valve spring.

20. The pump of claim 19, wherein:

an outer diameter of the outlet valve spring is greater than or equal to an outer inner diameter of the pump piston adjacent the dead coils.

21. A pump comprising:

a pump housing defining a pump chamber, the pump housing including an inlet opening, the pump housing further including a first inlet sealing surface;

a pump piston reciprocable in the pump housing in a first, axially-inward direction and a second, axially-outward direction, reciprocation in the first direction terminating at a first location at the bottom of a stroke of the pump piston, the pump piston including an outlet opening, the pump piston further including a first outlet sealing surface;

a piston spring biasing the pump piston in the second direction;

an inlet valve including a second inlet sealing surface, the second inlet sealing surface engaging the first inlet sealing surface to thereby close the inlet opening;

an outlet valve including a second outlet sealing surface, the second outlet sealing surface non-frictionally engaging the first outlet sealing surface to thereby close the outlet opening, wherein an axially outer end of the inlet valve cooperates with an axially inner end of the outlet valve, to thereby open the outlet opening when the pump piston is at the first location; and an outlet valve spring biasing the outlet valve to close the outlet opening.

22. The pump of claim 21, wherein:

the inlet valve is a ball valve.

23. The pump of claim 21, wherein:

the outlet valve is a stem valve.

24. The pump of claim 23, wherein:

the outlet valve includes an outlet valve engagement end engaging the inlet valve at the first location.

25. The pump of claim 21, wherein:

the outlet valve includes a valve sealing flange, the pump piston includes a piston sealing flange, the valve sealing flange and the piston sealing flange cooperating to close the outlet opening.

26. The pump of claim 25, wherein:

the valve sealing flange includes a conical sealing surface and the piston sealing flange includes a conical sealing surface.

27. The pump of claim 21, wherein:

the inlet valve is a stem valve.

28. The pump of claim 27, wherein:

the inlet valve includes an inlet valve engagement end engaging the outlet valve at the first location.

29. The pump of claim 27, wherein:

the inlet valve includes an inlet valve engagement end and the outlet valve includes an outlet valve engagement end, the inlet valve engagement end engaging the outlet valve engagement end at the first location.

30. The pump of claim 21, wherein:

the outlet valve includes a ball-check valve.

31. The pump of claim 30, wherein:

the inlet valve includes an inlet valve engagement end engaging the outlet valve at the first location.

32. The pump of claim 31, wherein:

the first outlet sealing surface engages the second outlet sealing surface non-frictionally.

33. A pump comprising:

a pump housing defining a pump chamber, the pump housing including an inlet opening, the pump housing further including a first inlet sealing surface;

a pump piston reciprocable in the pump housing in a first, axially-inward direction and a second, axially-outward direction, reciprocation in the first direction terminating at a first location at the bottom of a stroke of the pump piston, the pump piston including an outlet opening, the pump piston further including a first outlet sealing surface, the first outlet sealing surface including at least one axial slot;

a piston spring biasing the pump piston in the second direction;

an inlet valve including a second inlet sealing surface, the second inlet sealing surface engaging the first inlet sealing surface to thereby close the inlet opening;

an outlet valve including a second outlet sealing skirt, the second outlet sealing skirt engaging the first outlet sealing surface throughout movement of the outlet valve relative to the pump piston, the second outlet sealing skirt cooperating with the at least one axial slot to thereby open the outlet opening, wherein an axially outer end of the inlet valve cooperates with an axially inner end of the outlet valve, to thereby open the outlet opening when the pump piston is at the first location; and an outlet valve spring biasing the outlet valve to close the outlet opening.

34. The pump of claim 33, wherein:

the inlet valve is a ball valve.

35. The pump of claim 33, wherein:

the outlet valve is a stem valve.

36. The pump of claim 35, wherein:

the outlet valve includes an outlet valve engagement end engaging the inlet valve at the first location.

37. The pump of claim 33, wherein:

the valve includes a conical sealing surface and the piston includes a conical sealing surface.

38. The pump of claim 33, wherein:

the outlet valve includes at least one axial valve slot, the pump piston includes a piston sealing skirt, the at least one axial valve slot providing a bypass for fluid around the piston sealing skirt in an axially-outward position of the outlet valve.

39. The pump of claim 33, wherein:

the outlet valve spring includes dead coils at at least one end of the outlet valve spring.

40. The pump of claim 39, wherein:

the outlet valve spring includes dead coils at an axially-outward end of the outlet valve spring.

41. The pump of claim 40, wherein:

an outer diameter of the valve spring is greater than or equal to an outer inner diameter of the pump piston adjacent the dead coils.

42. A pump comprising:

a pump housing defining a pump chamber, the pump housing including an inlet opening, the pump housing further including a first inlet sealing surface;

a pump piston reciprocable in the pump housing in a first, axially-inward direction and a second, axially-outward direction, reciprocation in the first direction terminating at a first location at the bottom of a stroke of the pump piston, reciprocation in the second direction terminating at a second location at the top of a stroke of the pump piston, the pump piston including an outlet opening, the pump piston further including a first outlet sealing skirt;

a piston spring biasing the pump piston in the second direction;

an inlet valve including a second inlet sealing surface, the second inlet sealing surface engaging the first inlet sealing surface to thereby close the inlet opening;

an outlet valve including at least one axial slot, the at least one axial slot being located axially inward of the first outlet sealing surface at the second location of the pump piston, the outlet valve including a first outlet sealing surface, the first outlet sealing surface sealing against the first outlet sealing skirt in the second location of the pump piston to thereby close the outlet opening, wherein an axially outer end of the inlet valve cooperates with an axially inner end of the outlet valve, to thereby open the outlet opening when the pump piston is at the first location; and an outlet valve spring biasing the outlet valve to close the outlet opening.

43. The pump of claim 42, wherein:

the inlet valve is a ball valve.

44. The pump of claim 42, wherein:

the outlet valve includes an outlet valve engagement end engaging the inlet valve at the first location.

45. The pump of claim 42, wherein:

the outlet valve spring includes dead coils at at least one end of the outlet valve spring.

46. The pump of claim 1, further comprising:

an actuator, the outlet valve spring contacting the actuator.

47. The pump of claim 21, further comprising:

an actuator, the outlet valve spring contacting the actuator.

48. The pump of claim 33, further comprising:

an actuator, the outlet valve spring contacting the actuator.

49. The pump of claim 42, further comprising:

an actuator, the outlet valve spring contacting the actuator.

* * * * *

UNITED STATES PATENT AND TRADEMARK OFFICE

CERTIFICATE OF CORRECTION

PATENT NO. : 6,170,713 B1
DATED : January 9, 2001
INVENTOR(S) : Schultz

It is certified that error appears in the above-identified patent and that said Letters Patent is hereby corrected as shown below:

Title page,
Item [56], References Cited, change "4,144,897" to -- 4,144,987 --.

Signed and Sealed this

Twenty-fourth Day of September, 2002

*Attest:*

*Attesting Officer*

JAMES E. ROGAN
*Director of the United States Patent and Trademark Office*